US005693922A

United States Patent [19]

Tuohy et al.

[11] Patent Number: 5,693,922

[45] Date of Patent: Dec. 2, 1997

[54] DIVERTER SWITCH AND LINK SYSTEM FOR LOAD TAP CHANGER

[75] Inventors: John A. Tuohy, Humboldt; Leslie R. Wilson, Maryville; Stephen A. Perkins, Jackson, all of Tenn.

[73] Assignee: ABB Power T&D Company Inc., Raleigh, N.C.

[21] Appl. No.: 556,312

[22] Filed: Nov. 13, 1995

[51] Int. Cl.[6] ..... H01H 19/54; H01H 3/46

[52] U.S. Cl. ..... 200/17 R; 200/11 TC

[58] Field of Search ..... 200/8 R, 8 A, 200/11 TC, 18, 401, 400, 337

[56] References Cited

U.S. PATENT DOCUMENTS

| | | | |
|---|---|---|---|
| 3,250,865 | 5/1966 | Bleibtreu | 200/11 TC |
| 3,315,043 | 4/1967 | Baumgartner | 200/11 TC |
| 3,400,231 | 9/1968 | Bleibtreu | 200/11 TC |
| 3,495,059 | 2/1970 | Hardman et al. | 200/337 |
| 3,514,561 | 5/1970 | Ogawa | 218/92 |
| 3,632,908 | 1/1972 | Bleibtreu et al. | 200/11 TC |
| 3,902,030 | 8/1975 | Popa | 200/11 TC |
| 4,081,741 | 3/1978 | Palmer | 323/340 |
| 4,348,558 | 9/1982 | Johansson | 200/6 R |
| 4,472,615 | 9/1984 | Itoh et al. | 200/401 |
| 4,504,708 | 3/1985 | Hartig | 200/48 V |
| 4,644,112 | 2/1987 | Kranich, II | 200/16 F |

OTHER PUBLICATIONS

Technical Guide—On-Load Tap-Changes Type UZ, "ABB Components for the World's Transformer Industry," Sep. 30, 1993, Rev. 2.

Technical Guide—On-Load Tap-Changers Type UC, "ABB Components for the World's Transformer Industry," Oct. 15, 1993, Rev. 1.

*Primary Examiner*—J. R. Scott

*Attorney, Agent, or Firm*—Woodcock Washburn Kurtz Mackiewicz & Norris LLP

[57] ABSTRACT

A load tap changer (LTC) comprising in part a diverter switch is disclosed. The diverter switch includes a movable main contact (38); first and second fixed main contacts (**40*a*, 40*b*); a pantograph system (30) for translating a rotational motion of a shaft (22) to a substantially linear motion of the movable main contact; and a link system (10) comprising a gear (12) adapted to be rotated by a motor, a spring battery (26) for storing energy of the motor, link means (14, 16, 18) for coupling the gear to the spring battery, and the shaft (22**) coupled to the link means, wherein the spring battery is operable to rotate the shaft and to thereby effect the movement of the movable main contact. A predetermined amount of rotation of the shaft effects a movement of the movable main contact from a contacting relation with the first fixed main contact to a contacting relation with the second fixed main contact.

22 Claims, 7 Drawing Sheets

ON POSITION

OFF POSITION

ON POSITION

DIVERTER SWITCH AND LINK SYSTEM FOR LOAD TAP CHANGER

FIELD OF THE INVENTION

The present invention relates generally to electrical switching devices, and more particularly to a diverter switch and a link system therefor. Presently preferred embodiments of the invention are employed in a load tap changer (LTC) associated with a transformer.

BACKGROUND OF THE INVENTION

A load tap changer, or LTC, is a device employed to switch the connection of a load among various taps of a transformer. Such LTCs can be either of the reactance or resistance type. The manner in which an LTC is constructed and operated is well known to those skilled in the art, and thus will only be summarized now to provide relevant background information regarding the problems with the prior art and to place the present invention in context. A more detailed explanation of the operation of an LTC is illustrated in FIGS. 6A–6C and described below in connection with a detailed description of preferred embodiments of the invention.

Briefly, depending on the type of switching involved, it may or may not be necessary to ensure that a selector contact to which the load is to be connected is in a no-current state while the tap change is being performed. In such cases where it is necessary to ensure that the selector contact is in a no-current state, it is necessary to divert the current after selecting a new tap.

LTCs are often employed in applications involving high currents. Resistance type LTCs, for example, typically include a tap selector and a separate diverter switch having a number of parallel main current carrying, arcing and resistance contacts. These contacts are typically operated in a circular or flip-flop motion. The present invention particularly relates to a diverter switch for high current applications in which it is necessary or desired to parallel multiple contacts to permit the making and breaking of multiple contacts simultaneously. A disadvantage of prior art resistance type LTCs is their large overall size.

For lower current applications, the two functions of the diverter and tap selector switches are brought together in an "arcing tap switch LTC," which includes stationary contacts that are often placed in a circle, movable main contacts, main switching contacts, and transition contacts. An advantage of an arcing tap switch LTC is its relatively small size. A disadvantage is that it is difficult to parallel contacts when there is a circular motion. In other words, it is difficult to dispose multiple contacts in parallel such that a simple, direct (e.g., linear) movement of a movable main contact arm can be employed to divert a high current via a first set of multiple contacts to a second set.

SUMMARY OF THE INVENTION

An object of the present invention is to provide a diverter switch that can be implemented in a smaller size and includes parallel contacts, and that also has a high current capacity. The present invention achieves this goal by providing a diverter switch in which the main contacts, main switching contacts, and transition contacts are stationary and switching is performed by mowing one movable main contact. The movable main contact is preferably operated with a substantially linear motion that permits the paralleling of contacts to obtain a high current carrying capacity while permitting the LTC to be implemented in a relatively small size.

With reference to FIGS. 6A–6C, presently preferred embodiments of the invention include a movable main contact (38), first and second fixed main contacts (40*a*, 40*b*), and a pantograph system (30) coupled to the movable main contact (38). The fixed main contacts 40*a*, 40*b* may each comprise a set of one or more parallel fixed main contacts, thereby enhancing the current carrying capacity of the switch by permitting the movable main contact to simultaneously make or break all members of a set of the fixed main contacts 40*a*, 40*b*. The pantograph system includes means for translating a rotational motion of a shaft (22) of a drive or link system (10) to a substantially linear motion of the movable main contact (38), wherein a predetermined amount of rotation of the shaft effects a movement of the movable main contact from a contacting relation with the first fixed main contact (40*a*) to a contacting relation with the second fixed main contact (40*b*).

The presently preferred embodiment also includes first and second fixed main switching contacts (42*a*, 42*b*). The fixed main switching contacts 42*a*, 42*b* may each comprise a set of one or more parallel fixed main switching contacts. In addition, the preferred embodiment includes first and second fixed transition contacts (44*a*, 44*b*), which may each comprise a set of one or more parallel contacts.

The preferred embodiment also includes the link system (10) comprising a gear (12) adapted to be rotated by a motor (80), a spring battery (26) for storing energy of the motor, link means (14, 16, 18) for coupling the gear to the spring battery, and the shaft (22) coupled to the link means. The spring battery is operable to rotate the shaft (22) and to thereby effect the movements of the movable main contact (38).

Other features of the invention are described below.

BRIEF DESCRIPTION OF THE DRAWINGS

FIG. 6A depicts the diverter switch in the position shown in FIGS. 3A and 3B; FIG. 6B depicts the diverter switch in the position shown in FIGS. 4A and 4B; and FIG. 6C depicts the diverter switch in the position shown in FIGS. 5A and 5B.

DETAILED DESCRIPTION OF PREFERRED EMBODIMENTS

Figure 1B:
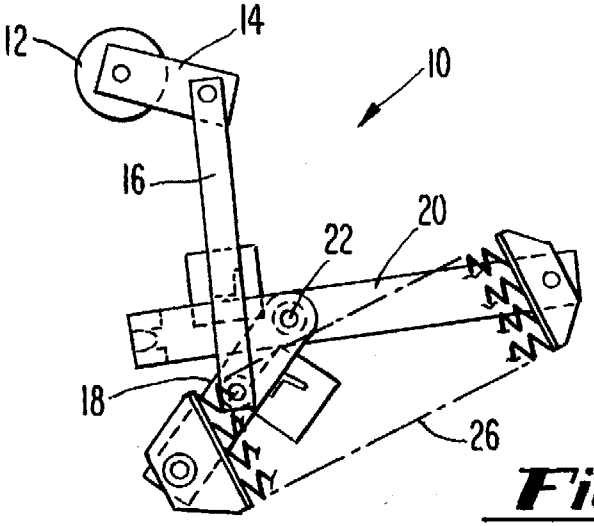
FIGS. 1A through 1D depict various phases of the operation of a link system 10 in accordance with the present invention.
Figure 1D:
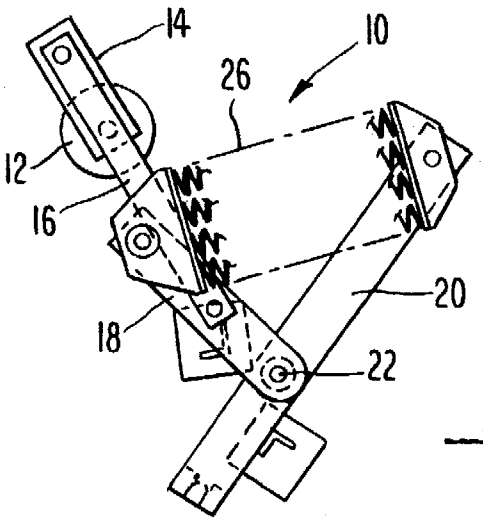
Figure 1A:
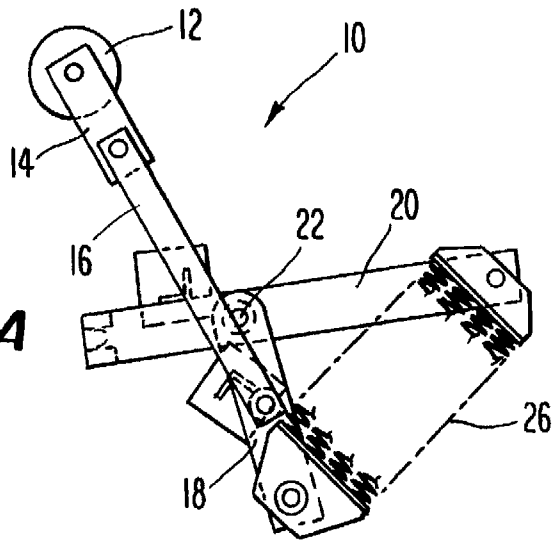
Figure 1C:
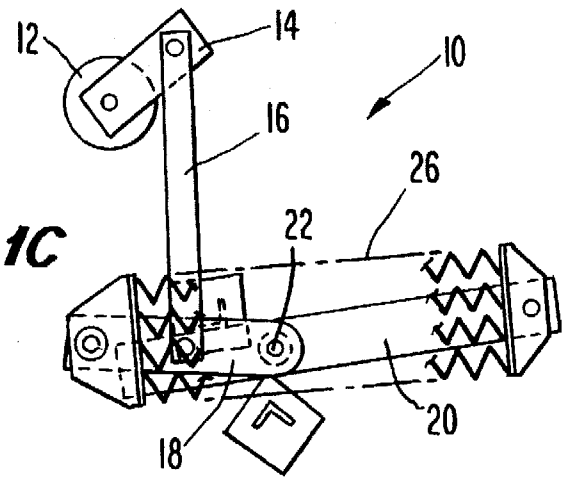

In one presently preferred embodiment of the invention, a system of gears (not shown) is employed to convert turns, for example five turns, of an outgoing shaft of a motor drive (not shown) to one complete operation of the LTC. This set of gears (not shown) converts these turns to one-half turn of a gear 12 coupled to a drive or link system as shown in FIGS. 1A–1D. As the gear 12 turns, it begins to charge a spring battery 26 by means of first, second, and third links 14, 16, 18, as shown. FIG. 1A depicts the link system 10 in a first state in which the spring battery 26 is uncharged. FIG. 1B depicts the link system 10 as the motor (ref. no. 80 in FIG. 6A) begins rotating the gear 12 to charge the spring battery 26. The springs of the spring battery 26 are eventually charged as shown in FIG. 1C. When released, the springs pull a driving link 20 to the position shown in FIG. 1D. The driving link 20 causes a high speed circular movement of shaft 22. A further one-half turn of gear 12 flips the driving link 20 back to its original position, as shown in FIG. 1A which results in a similar circular motion of shaft 22 but in the opposite direction.

Figure 2C:
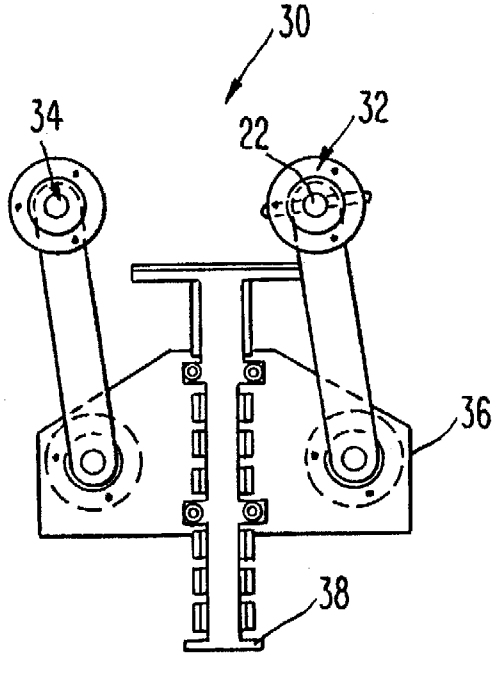
FIGS. 2A through 2C depict various phases of the operation a pantograph system 30 in accordance with the present invention.
Figure 2B:
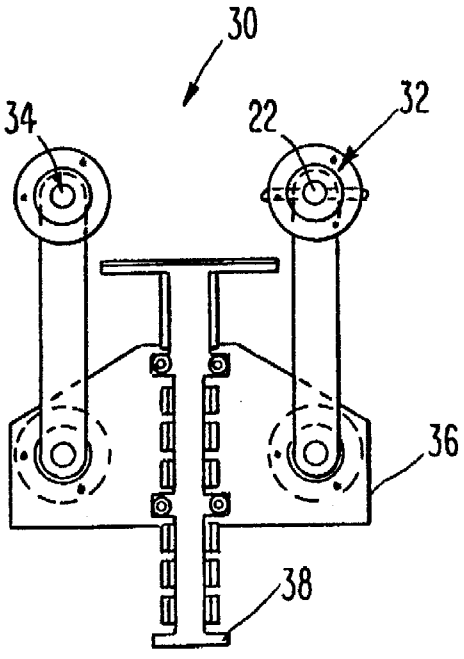
Figure 2A:
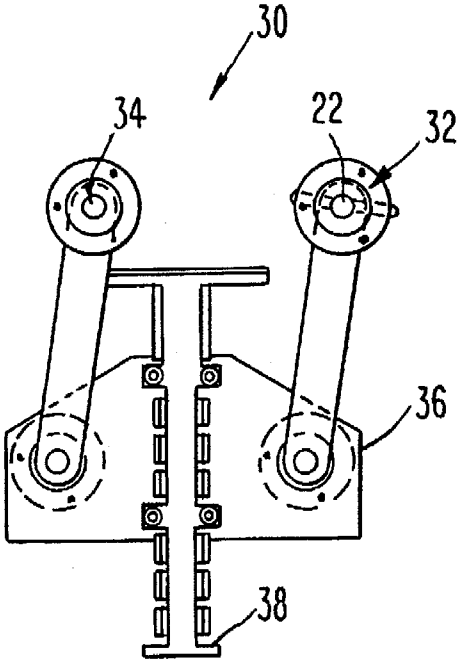

FIGS. 2A–2C illustrate how the circular motion of the gear 12 (not shown in FIGS. 2A–2C but shown in FIGS. 1A–1D) and shaft 22 drives a pantograph system 30, which includes stationary points 32, 34; a pantograph 36, and a movable main contact 38. The movable main contact 38 is moved in a linear motion from left to right in the plane of FIGS. 2A–2C. FIG. 2A illustrates the movable main contact 38 in its initial position. FIG. 2B depicts the movable main contact in its intermediate position. FIG. 2C depicts the movable main contact in its final position after a tap change has been made. In the preferred embodiment, the movable main contact 38 moves approximately 70 mm from its initial position of FIG. 2A to its final position of FIG. 2C. This amount of linear movement corresponds to approximately 16° of rotation of the drive shaft 22.

Figure 3B:
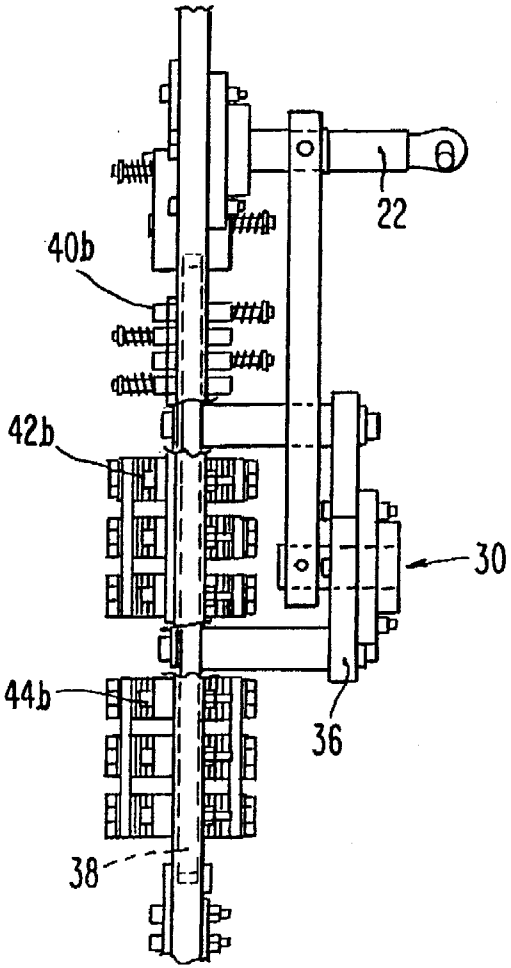
FIGS. 3A and 3B depict front and side views of an inventive diverter switch comprising a pantograph system, and moving and stationary contacts.
Figure 3A:
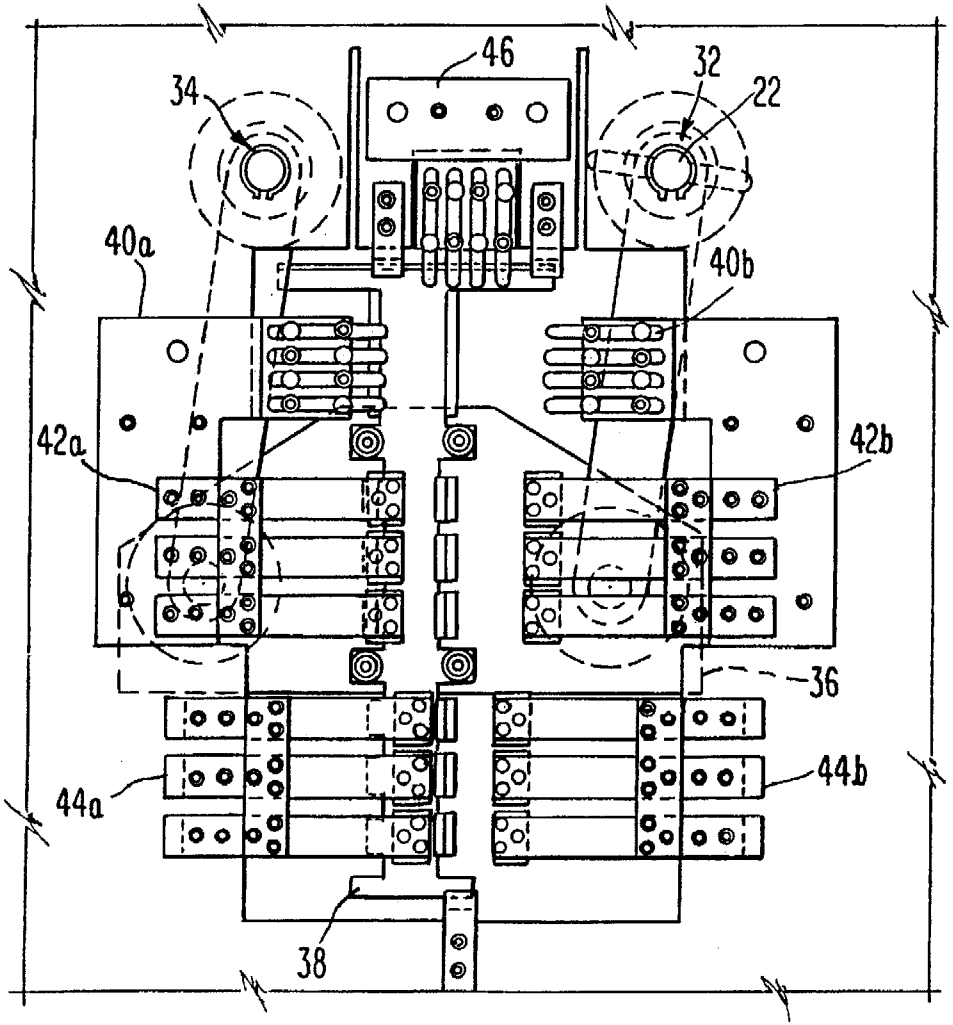
Figure 4B:
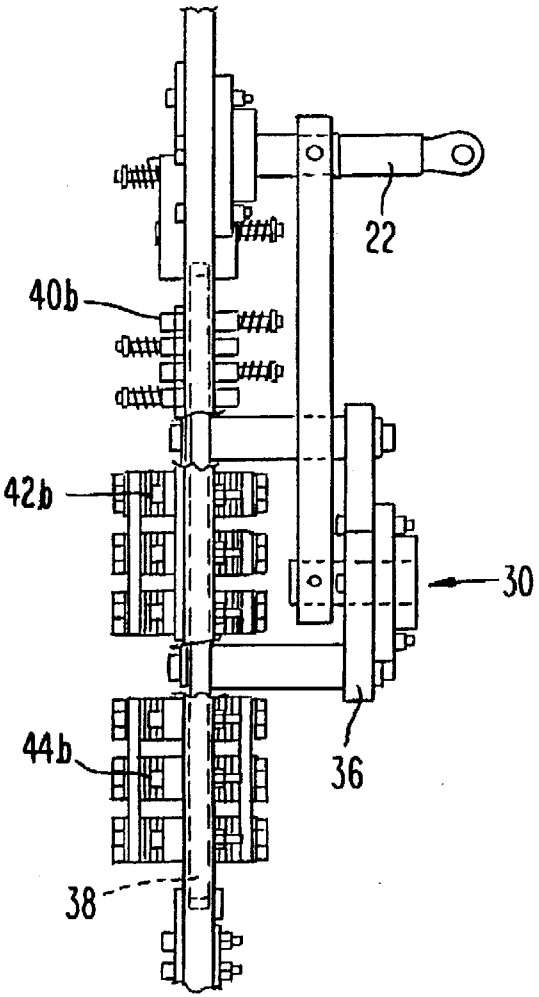
FIGS. 4A, 4B and 5A, 5B depict views similar to those depicted by FIGS. 3A and 3B but with the moving main contact in different positions.
Figure 4A:
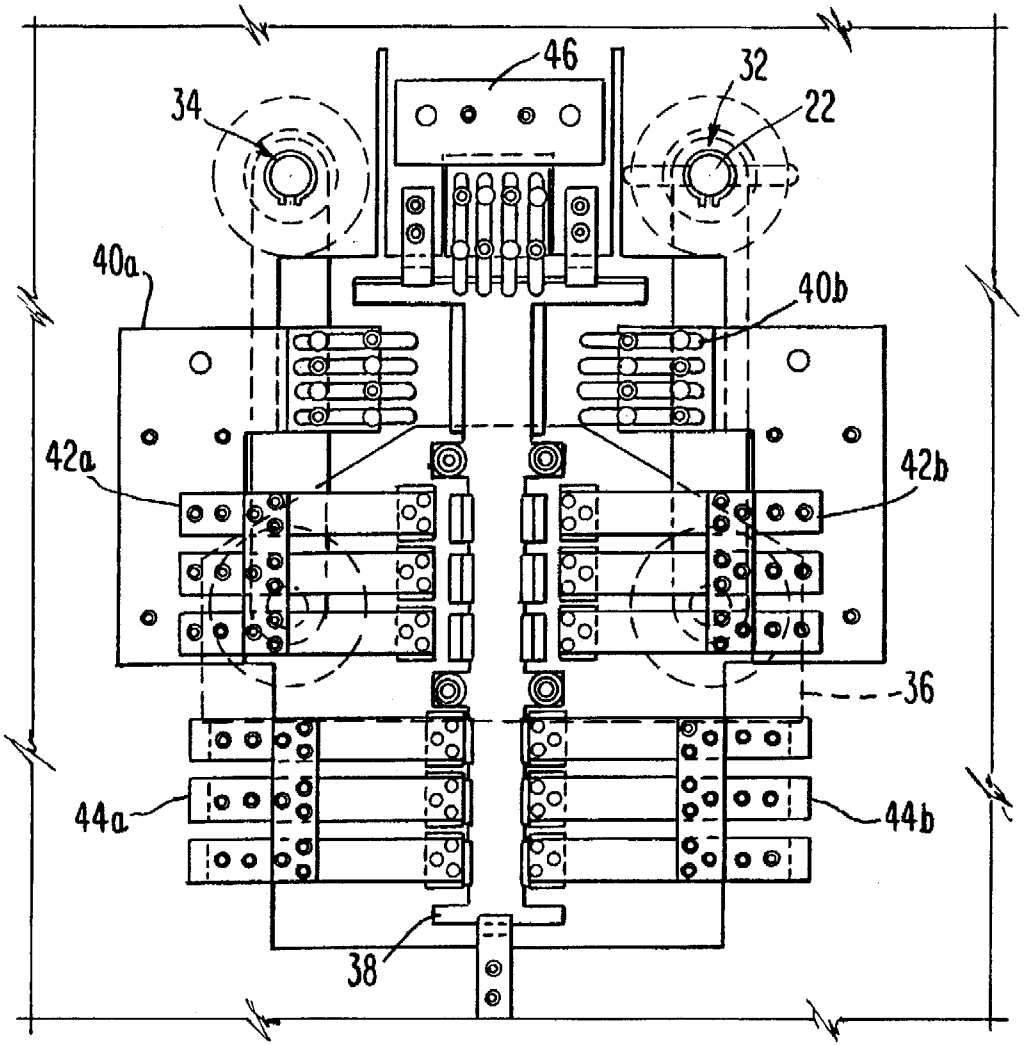

FIGS. 3A and 3B depict the movable main contact 38 in its "on position" in which current flows through a current collector 46 and the movable main contact 38 to a fixed main contact **40*a*. In FIGS. 4A and 4B, the movable main contact 38 is shown in its intermediate position in which current flows through the current collector 46 and the movable main contact 38 to both sides of the diverter switch via transition contacts 44*a* and 44*b***.

Figure 5B:
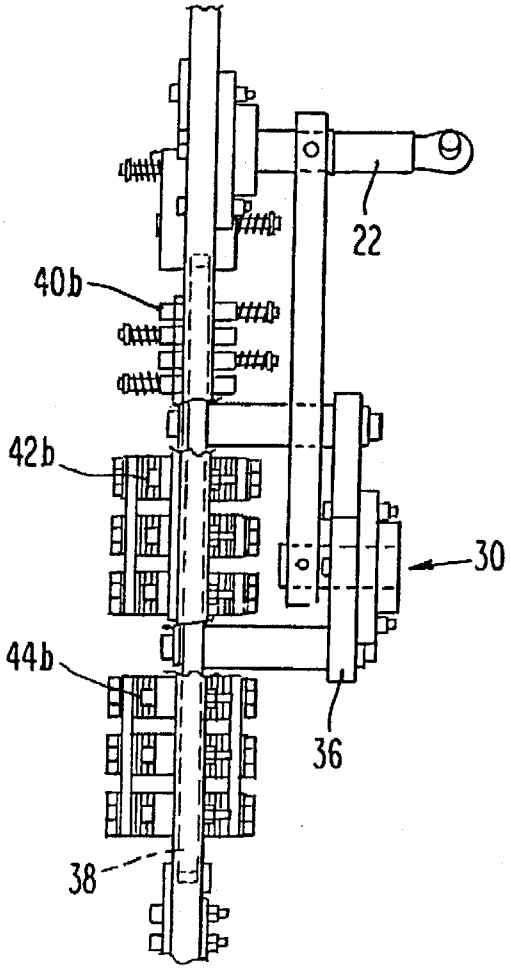
Figure 5A:
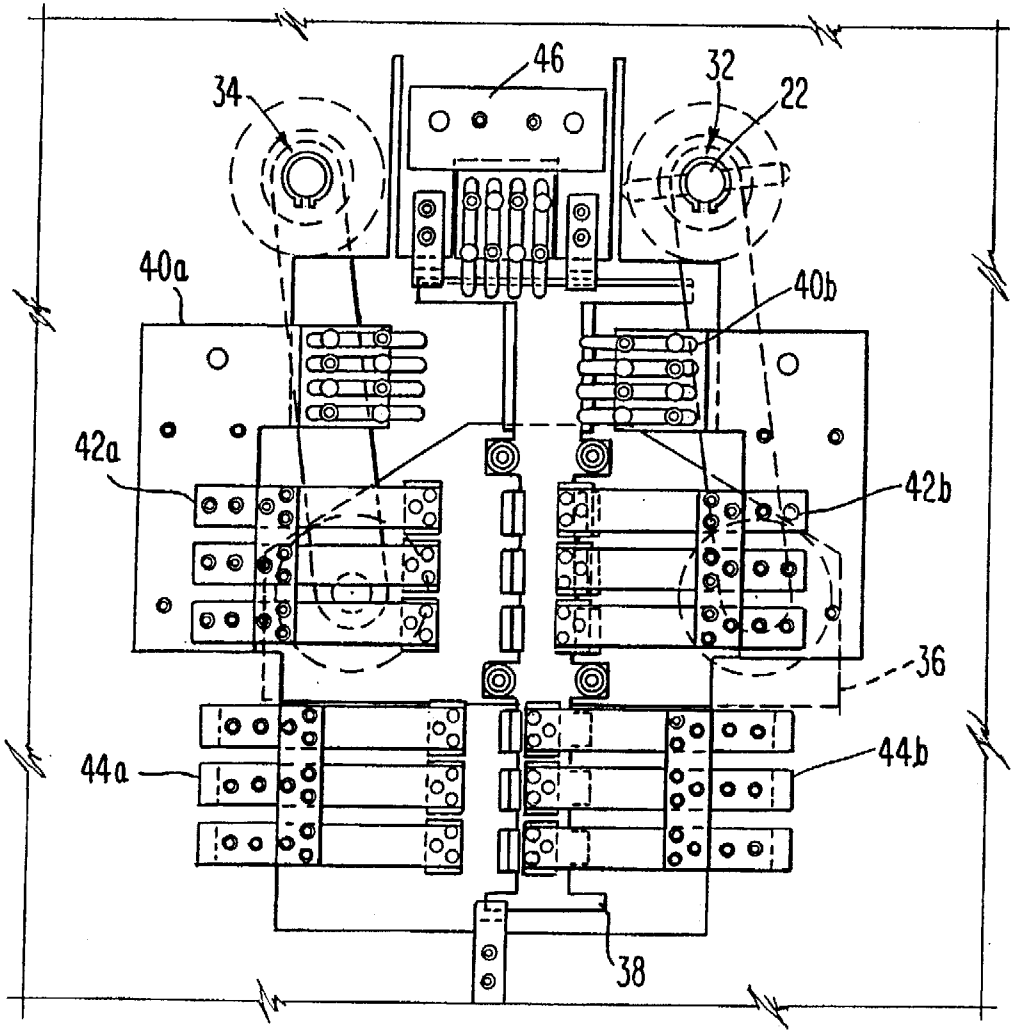

FIGS. 5A and 5B depict the movable main contact 38 in its opposite position. Current is now flowing through the current collector 46 and the movable main contact 38 to fixed main contact **40*b* on the opposite side of the diverter switch from fixed main contact 40*a***.

Figure 6A:
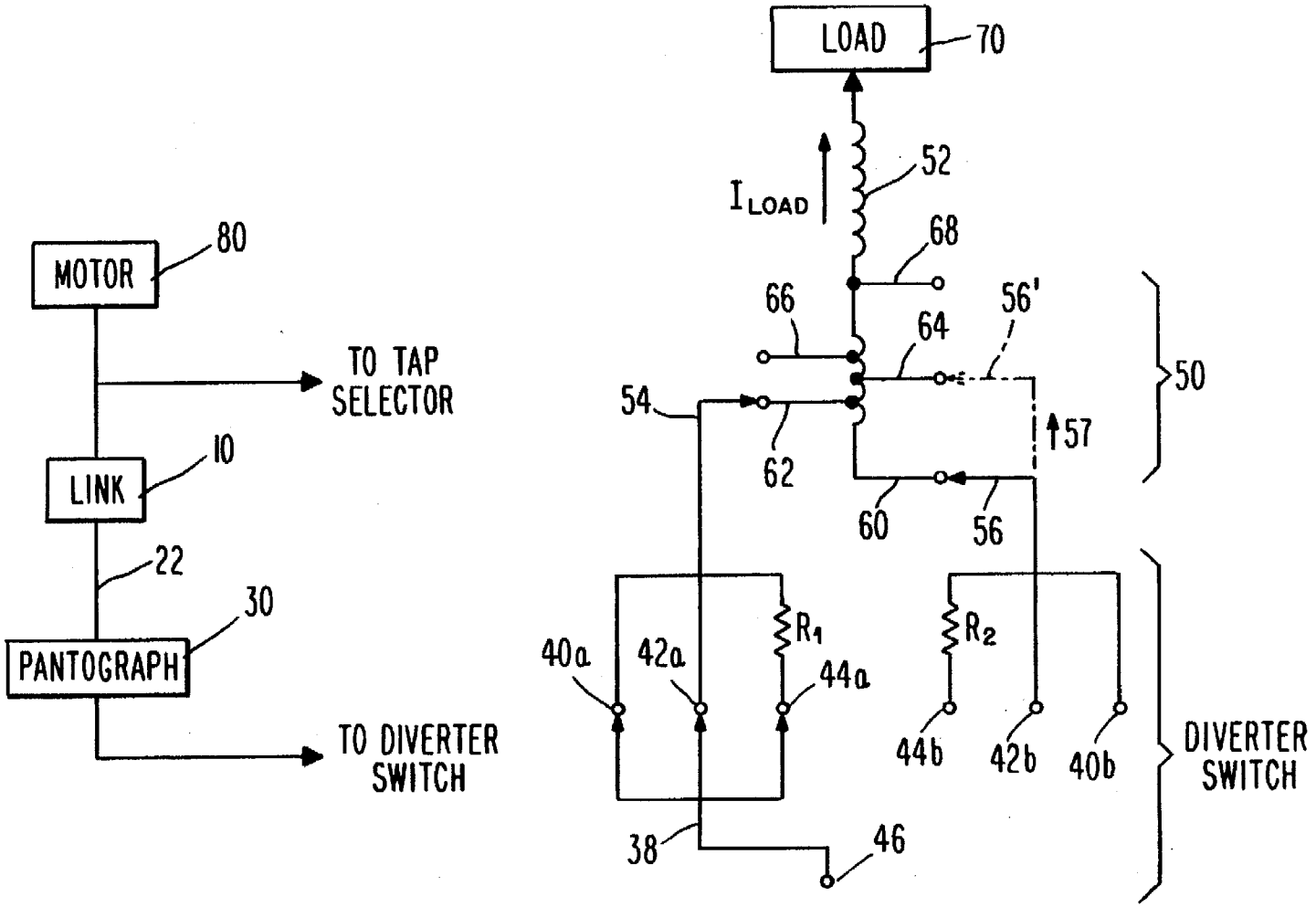
FIGS. 6A through 6C diagrammatically and schematically depict the connection of an LTC in accordance with the present invention to a load and the regulating winding of a transformer.
Figure 6B:
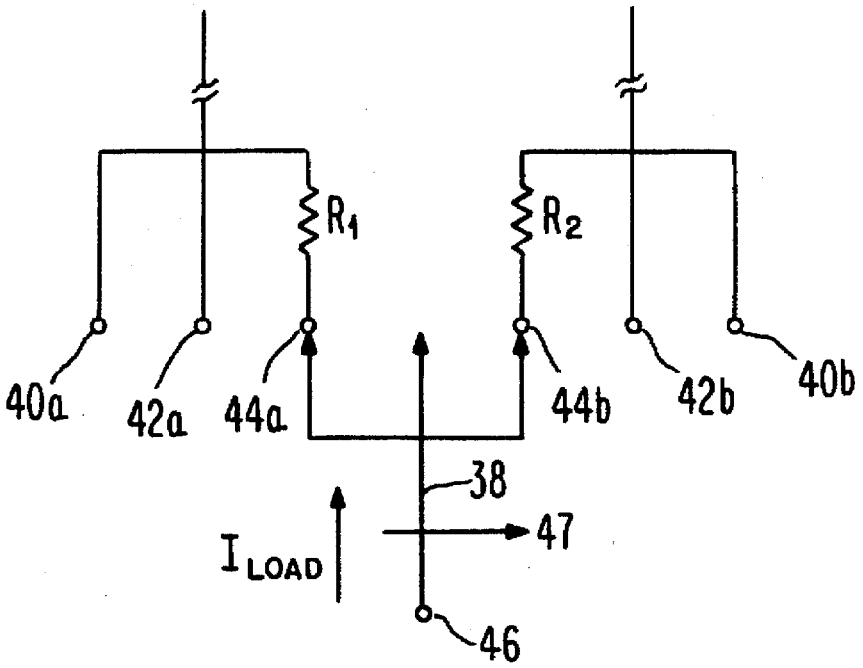
Figure 6C:
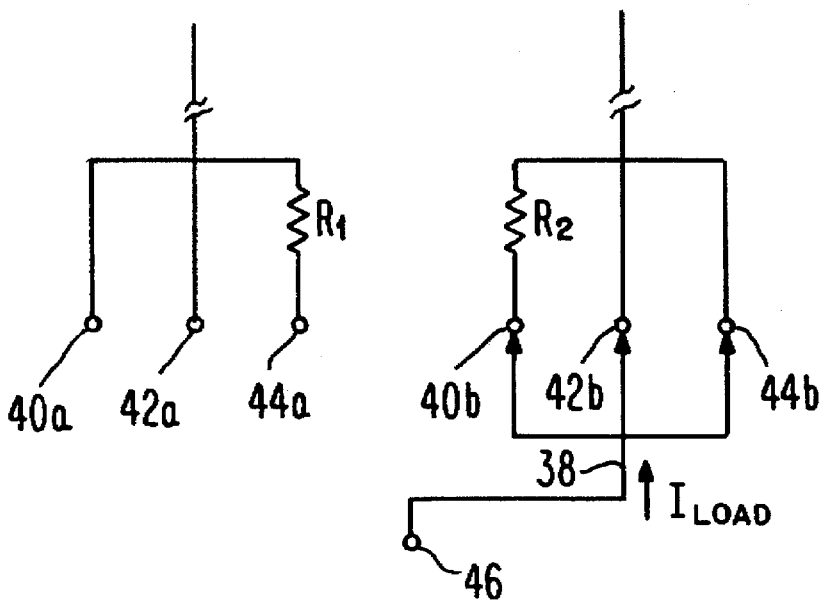

FIGS. 6A through 6C schematically depict a typical connection diagram of the diverter switch, link system 10, 22 pantograph system 30, load 70, motor 80, tap selector 50 and regulating winding of a transformer (the transformer not being shown in its entirety). A main winding 52 of the transformer is connected to the regulating winding/tap selector 50 as shown. The load 70 is operatively coupled or electrically connected to the main winding of the transformer 52. FIGS. 6A–6C also depict a first tap selector arm 54 and a second tap selector arm 56; and first, second, third, fourth and fifth tap positions, respectively denoted 60, 62, 64, 66, and 68. Also shown are main switching contact resistors $R_1$, $R_2$, connected to contacts **44*a* and 44*b*, respectively. It should be noted that the individual contacts 40*a*, 42*a*, 44*a* and their counterparts 40*b*, 42*b*, 44*b* may be, and preferably are, each a set of two or more parallel contacts. For example, in the embodiment of FIGS. 3A, 3B, 4A, 4B, and 5A, 5B, the fixed main contacts 40*a* and 40*b*** each comprise four contacts vertically aligned in parallel as shown.

FIG. 6A depicts the diverter switch in the position shown in FIGS. 3A and 3B. In this example, the selector contact 54 lies on tap position 62 and selector contact 56 lies on tap position 60. Now, assume that it is necessary to move selector contact 56 from tap position 60 to tap position 64 as indicated by the dashed symbol 56' and the arrow 57. According to a preferred method of operating the LTC, and as illustrated in FIG. 6A, the tap selector contact is repositioned while it is in a no-current state, i.e., while the load current $I_{LOAD}$ flows entirely through the fixed main contact **40*a*, the movable main contact 38 and load 70 (fixed main switching contacts 42*a* and fixed transition contacts 44*a*** are bypassed in FIG. 6A).

FIG. 6B depicts the diverter switch in the position shown in FIGS. 4A and 4B. In this depiction, tap selector contact 56 has been repositioned to tap position 64 and the movable main contact 38 of the diverter switch has been moved linearly (as indicated by arrow 47) to its intermediate position in which it bridges transition contacts **44*a* and 44*b***. In this state, the load current $I_{LOAD}$ is shared by resistors $R_1$ and $R_2$ and any circulating current is limited by the resistance sum $R_1$ plus $R_2$.

FIG. 6C depicts the diverter switch in the position shown in FIGS. 5A and 5B. The movable main contact 38 in this depiction is positioned so that the load current $I_{LOAD}$ flows entirely through the fixed main contact **40*b*, the movable main contact 38 and load 70**.

Those skilled in the art will recognize that the above description is not complete in the sense that there are a number of states of the diverter switch in which the movable main contact 38 is in a position somewhere between those positions illustrated in FIGS. 6A–6C. However, the above description is sufficient to enable one skilled in the art to make and use the present invention.

In sum, presently preferred embodiments of the invention include (1) a link system that, when driven by a motor, operates a spring battery to provide the required motion of a driving shaft; and (2) a pantograph system that translates the driving shaft motion to a linear motion of the movable main contact of the diverter switch. According to the invention, a predetermined amount of rotation of the drive shaft effects a movement of the movable main contact from a contacting relation with a first fixed main contact to a contacting relation with a second fixed main contact.

It should be noted that driving a diverter switch with a spring battery and the sequence described above of making and breaking contacts are now commonly employed in LTCs. An important distinguishing feature of the present invention is that the link system operates the spring battery in such a way as to provide motion that operates the pantograph system and provides a substantially linear motion to the movable main contact. This feature makes it possible to have the main contact, main switching contacts and transition contacts stationary. An overall result of the invention is that it permits one to easily parallel contacts in a relatively small LTC having a higher current rating than previously believed to be possible. In this way, the present invention provides unexpectedly good results in achieving the objects set forth above.

The scope of protection of the following claims is not intended to be limited to the presently preferred embodiments disclosed herein. Those skilled in the art will readily appreciate that many modifications can be made to the preferred embodiments described herein.

We claim:

1. A diverter switch comprising:

(a) a single movable main contact;

(b) first and second fixed main contacts, and (c) a pantograph system coupled to said single movable main contact, said pantograph system comprising means for translating a rotational motion of a shaft of a drive system to a substantially linear motion of said single movable main contact, wherein a predetermined amount of rotation of said shaft effects a movement of said single movable main contact from a contacting relation with said first fixed main contact to a contacting relation with said second fixed main contact.

2. A diverter switch as recited in claim 1, further comprising first and second fixed main switching contacts wherein a second predetermined amount of rotation of said shaft effects a movement of said movable main contact from a contacting relation with said first fixed main switching contact to a contacting relation with said second fixed main switching contact.

3. A diverter switch as recited in claim 2, wherein said first and second fixed main switching contacts each comprise a set of two or more fixed contacts disposed in parallel such that the movable main contact simultaneously makes or breaks all members of a set.

4. A diverter switch comprising:

(a) a movable main contact;

(b) first and second fixed main contacts;

(c) a pantograph system coupled to said movable main contact, said pantograph system comprising means for translating a rotational motion of a shaft of a drive system to a substantially linear motion of said movable main contact, wherein a predetermined amount of rotation of said shaft effects a movement of said movable main contact from a contacting relation with said first fixed main contact to a contacting relation with said second fixed main contact;

(d) first and second fixed main switching contacts wherein a second predetermined amount of rotation of said shaft effects a movement of said movable main contact from a contacting relation with said first fixed main switching contact to a contacting relation with said second fixed main switching contact, said first and second fixed main switching contacts each comprising a set of two or more fixed contacts disposed in parallel such that the movable main contact simultaneously makes or breaks all members of a set; and (e) first and second fixed transition contacts, wherein a third predetermined amount of rotation of said shaft effects a movement of said movable main contact from a contacting relation with said first fixed main contact to a contacting relation with both said first and second fixed transition contacts.

5. A diverter switch as recited in 4, wherein said first and second fixed transition contacts each comprise a set of two or more fixed contacts disposed in parallel such that the movable main contact simultaneously makes or breaks all members of a set.

6. A diverter switch as recited in claim 1, further comprising a link system comprising a rotatable gear, a spring battery, link means for coupling said gear to said spring battery, said gear through said link means and upon rotation of said gear storing energy in said spring battery thereby charging said spring battery, and said shaft coupled to said link means, wherein said spring battery, when charged, is operable to rotate said shaft and to thereby effect said movements of said movable main contact.

7. A diverter switch as recited in claim 1, wherein said fixed main contacts each comprise a set of two or more fixed contacts disposed in parallel such that the single movable main contact simultaneously makes or breaks all members of a set.

8. A switching system comprising:

(a) a single movable main contact;

(b) first and second fixed main contacts; and (c) moving means coupled to said single movable main contact for translating a rotational motion of a shaft to a substantially linear motion of said single movable main contact, wherein a predetermined amount of rotation of said shaft effects a movement of said single movable main contact from a contacting relation with said first fixed main contact to a contacting relation with said second fixed main contact.

9. A switching system as recited in claim 8, further comprising a link system comprising a rotatable gear, a spring battery, link means for coupling said gear to said spring battery, said gear through said link means and upon rotation of said gear storing energy in said spring battery thereby charging said spring battery, and said shaft coupled to said link means, wherein said spring battery, when charged, is operable to rotate said shaft and to thereby effect said movements of said movable main contact.

10. A switching system as recited in claim 8, further comprising first and second fixed main switching contacts, wherein a second predetermined amount of rotation of said shaft effects a movement of said movable main contact from a contacting relation with said first fixed main switching contact to a contacting relation with said second fixed main switching contact.

11. A diverter switch as recited in claim 10, wherein said first and second fixed main switching contacts each comprise a set of two or more fixed contacts disposed in parallel such that the movable main contact simultaneously makes or breaks all members of a set.

12. A switching system as recited in claim 10, further comprising first and second fixed transition contacts, wherein a third predetermined amount of rotation of said shaft effects a movement of said movable main contact from a contacting relation with said first fixed main contact to a contacting relation with both said first and second fixed transition contacts.

13. A diverter switch as recited in claim 12, wherein said first and second fixed transition contacts each comprise a set of two or more fixed contacts disposed in parallel such that the movable main contact simultaneously makes or breaks all members of a set.

14. A switching system as recited in claim 8, wherein said fixed main contacts each comprise a set of two or more fixed contacts disposed in parallel such that the movable main contact simultaneously makes or breaks all members of a set.

15. A switching system as recited in claim 8, wherein said moving means comprises a pantograph coupled to said movable contact and said shaft.

16. A load tap changer (LTC) comprising a diverter switch, said diverter switch comprising a movable main contact; first and second fixed main contacts; moving means coupled to said movable main contact for translating a rotational motion of a shaft to a substantially linear motion of said movable main contact, wherein a predetermined amount of rotation of said shaft effects a movement of said movable main contact from a contacting relation with said first fixed main contact to a contacting relation with said second fixed main contact; and a link system comprising a rotatable gear, a spring battery, link means for coupling said gear to said spring battery, said gear through said link means and upon rotation thereof storing energy in said spring battery thereby charging said spring battery, and said shaft coupled to said link means, wherein said spring battery, when charged, is operable to rotate said shaft and to thereby effect said movement of said movable main contact.

17. A load tap changer as recited in claim 16, further comprising first and second fixed main switching contacts, wherein a second predetermined amount of rotation of said shaft effects a movement of said movable main contact from a contacting relation with said first fixed main switching contact to a contacting relation with said second fixed main switching contact.

18. A diverter switch as recited in claim 17, wherein said first and second fixed main switching contacts each comprise a set of two or more fixed contacts disposed in parallel such that the movable main contact simultaneously makes or breaks all members of a set.

19. A load tap changer as recited in claim 17, further comprising first and second fixed transition contacts, wherein a third predetermined amount of rotation of said shaft effects a movement of said movable main contact from a contacting relation with said first fixed main contact to a contacting relation with both said first and second fixed transition contacts.

20. A diverter switch as recited in claim 19, wherein said first and second transition contacts each comprise a set of two or more fixed contacts disposed in parallel such that the movable main contact simultaneously makes or breaks all members of a set.

21. A load tap changer as recited in claim 19, wherein said fixed main contacts each comprise a set of two or more fixed contacts disposed in parallel such that the movable main contact simultaneously makes or breaks all members of a set.

22. A load tap changer as recited in claim 21, wherein said moving means comprises a pantograph coupled to said movable contact and said shaft.

* * * * *